US009734941B2

(12) United States Patent
Kitamura

(10) Patent No.: US 9,734,941 B2
(45) Date of Patent: Aug. 15, 2017

(54) SURFACE-MOUNT INDUCTOR

(71) Applicant: TOKO, INC., Tsurugashima-shi, Saitama-ken (JP)

(72) Inventor: Kazuhisa Kitamura, Tsurugashima (JP)

(73) Assignee: Murata Manufacturing Co., Ltd., Nagaokakyo-shi, Kyoto (JP)

( * ) Notice: Subject to any disclaimer, the term of this patent is extended or adjusted under 35 U.S.C. 154(b) by 0 days.

(21) Appl. No.: 14/926,020

(22) Filed: Oct. 29, 2015

(65) Prior Publication Data

US 2016/0126005 A1 May 5, 2016

(30) Foreign Application Priority Data

Oct. 31, 2014 (JP) ..... 2014-222416
Oct. 31, 2014 (JP) ..... 2014-222417
Oct. 31, 2014 (JP) ..... 2014-222418
Oct. 31, 2014 (JP) ..... 2014-222419

(51) Int. Cl.

| | |
|---|---|
| ***H01F 17/04*** | (2006.01) |
| ***H01F 27/28*** | (2006.01) |
| ***H01F 27/29*** | (2006.01) |
| ***H01F 41/061*** | (2016.01) |
| ***H01F 41/098*** | (2016.01) |

(52) U.S. Cl.

CPC ..... *H01F 17/043* (2013.01); *H01F 27/2852* (2013.01); *H01F 27/292* (2013.01); *H01F 41/061* (2016.01); *H01F 41/098* (2016.01)

(58) Field of Classification Search

CPC ..... H01F 27/2804; H01F 27/2852; H01F 27/292; H01F 27/2847; H01F 2017/046; H01F 17/043; H01F 5/06; H01F 41/061; H01F 41/041; H01F 41/098

USPC ..... 336/212, 221, 222, 192, 83, 233

See application file for complete search history.

(56) References Cited

U.S. PATENT DOCUMENTS 5,321,965 A * 6/1994 Baird ..... B21F 3/04 72/142
2010/0259353 A1* 10/2010 Saito ..... H01F 27/292 336/205
2011/0005064 A1* 1/2011 Klesyk ..... H01F 27/027 29/605

(Continued)

FOREIGN PATENT DOCUMENTS

JP 2004-193215 A 7/2004
JP 2003-290992 A 10/2013

*Primary Examiner* — Mangtin Lian

(74) *Attorney, Agent, or Firm* — Renner, Kenner, Greive, Bobak, Taylor & Weber

(57) ABSTRACT

A surface-mount inductor having a molded body which includes a coil formed by winding a rectangular wire and sealed by sealant having resin and filler, a surface of the molded body being a mounting face, the coil includes: first rolls wound in two-roll arrangement along the winding axis, the ends of the wire being placed at the outermost turn; and second rolls wound in positions adjacent to the first rolls and oppositely shifted along the winding axis, the inner diameter being equal to or larger than the outer diameter of the first rolls, the ends of the wire are brought out from the outermost turn of the second rolls as lead ends which are sealed in a manner that the winding axis is parallel with the mounting face and the lead ends are partially exposed at the mounting face, as well as a method for manufacturing the same.

4 Claims, 12 Drawing Sheets

(56) References Cited

U.S. PATENT DOCUMENTS

2014/0145667 A1* 5/2014 Damjanovic ..... H02P 1/26
318/778

* cited by examiner

SURFACE-MOUNT INDUCTOR

CROSS REFERENCE TO RELATED APPLICATIONS

This application is based upon and claims the benefit of priority from the prior Japanese Patent Application No. 2014-222416, filed on Oct. 31, 2014, Japanese Patent Application No. 2014-222417, filed on Oct. 31, 2014, Japanese Patent Application No. 2014-222418, filed on Oct. 31, 2014, and Japanese Patent Application No. 2014-222419, filed on Oct. 31, 2014, the entire contents of which are incorporated herein by reference.

BACKGROUND OF THE INVENTION

1. Field of the Invention

The present invention relates to a surface-mount inductor and a method for manufacturing the same.

2. Description of the Related Art

Conventionally, surface-mount inductors which coil has been coated with thermoplastic sealants (molding materials) containing magnetic powder and resin are widely used. For example, JP2003-290992 discloses a method for manufacturing surface-mount inductors using metal pieces as external terminals. The surface-mount inductors have external terminals which are metal pieces welded to lead ends which are processed to serve as external terminals.

JP2004-193215 discloses a method for manufacturing surface-mount inductors by coating coils, which is configured by winding a wire having a rectangular section (hereinafter "rectangular wire"), with sealing material. The surface-mount inductor has external terminals which are formed by deforming lead wires of a coil.

SUMMARY OF THE INVENTION

In a surface-mount inductor disclosed in JP2003-290992, since its coil ends are welded to metal pieces, the contact portions of the coil ends and of the metal pieces are exposed to thermal and mechanical stresses. In addition, contact resistance occurs at the contact portions of the coil ends and metal pieces.

In the surface-mount inductor of JP2004-193215, since the direction of the winding axis of the coil is orthogonal to the wide surface of the rectangular wire, the inner and outer diameters are exposed to mechanical stress during winding.

Further, the surface-mount inductor in JP 2004-193215 is configured so that one lead end goes from its bottom side to the bottom and the other lead end goes from upper side to the bottom.

In this case, because of the difference in the length of the lead wires, the shape of the coil is asymmetrical. The surface-mount inductor incorporating an asymmetrical coil requires a step of marking the polarity of the terminals, since the electric characteristics when inputting in one terminal are different from those when inputting in the other terminal.

Consequently, the present invention aims to provide a surface-mount inductor that incorporates a symmetrical coil, has less mechanical and thermal stresses, eliminates contact resistance between a coil and the external terminals, and provides a method for manufacturing of the same.

Means for Solving the Problem

A surface-mount inductor according to the present invention is characterized by being provided with a molded body which includes a coil formed by winding a rectangular wire which is sealed using sealant containing resin and filler, at least a surface of the molded body being a mounting face, wherein the coil comprises:

two first rolls wound in a two-roll arrangement along the winding axis, the ends of the wire being brought out to their outermost turn; and two second rolls wound in positions adjacent to and each on opposite sides of the first rolls along the winding axis, the diameter of the innermost turn (inner diameter) being equal to or larger than the diameter of the outermost turn (outer diameter) of the first rolls, the ends of the wire are brought out from the outermost turn of the second rolls as lead ends which are coated in a manner that the winding axis is parallel with the mounting face and that the lead ends are at least partially exposed toward on the side of the mounting face.

A method for manufacturing a surface-mount inductor according to the present invention is characterized in that: the method comprises a molded body which includes a coil formed by winding a rectangular wire which is sealed using sealant containing resin and filler, a surface of the molded body being a mounting surface, wherein winding two first rolls, putting in contact a median portion of the wire to a spindle of a winding machine and then positioning the ends at the outermost turn so as to form a two-roll arrangement along the winding axis, winding two second rolls in positions adjacent and each on opposite sides of the first rolls along the winding axis, the inner diameter being equal to or larger than the outer diameter of the first rolls;

bringing out the lead ends from the outermost turn of the second rolls so as to make a coil, fitting a pair of blocks at the both ends of the coil, and thermocompressing them to form a molded body including the coil, and forming a surface-mount inductor in which the winding axis of the coil is parallel with the mounting face of the molded body and the lead ends are at least partially exposed toward the molded body.

Effect of the Invention

According to the surface-mount inductor and the manufacturing method of the same as described in the present application, since the lead ends of coil are used as external terminals, the thermal and mechanical stresses are decreased and the contact resistance between the coil and the external terminals are eliminated. Further, since the direction of the winding axis and that of the wide surface of the coil are parallel, the mechanical stress caused at the inner and outer diameter portions may be decreased. In addition, since the coil is wound such that the direction of the mounting face of the surface-mount inductor and the direction of winding axis of the coil are parallel, the shape of the coil may be symmetrical.

Therefore, a surface-mount inductor, which serves to decrease the thermal and mechanical stresses and the contact resistance, and to solve the issue of polarities of electrical characteristics polarity, as well as a method for manufacturing the same can be provided.

BRIEF DESCRIPTION OF THE DRAWINGS

FIG. 14B showing the case when only one side of the metal body is in contact with, while the other side of the metal body and the lead ends are not in contact with, the terminals of a tester; FIG. 14C showing the case when both lead ends are in contact with the terminals of a tester; and FIG. 14D showing the case when both sides of the metal body and both lead ends are in contact with the terminals of a tester.

DETAILED DESCRIPTION OF THE INVENTION

Embodiment 1

The first embodiment of a surface mount inductor according to the present invention will now be described with reference to FIGS. 1 through 7.

Figure 1:
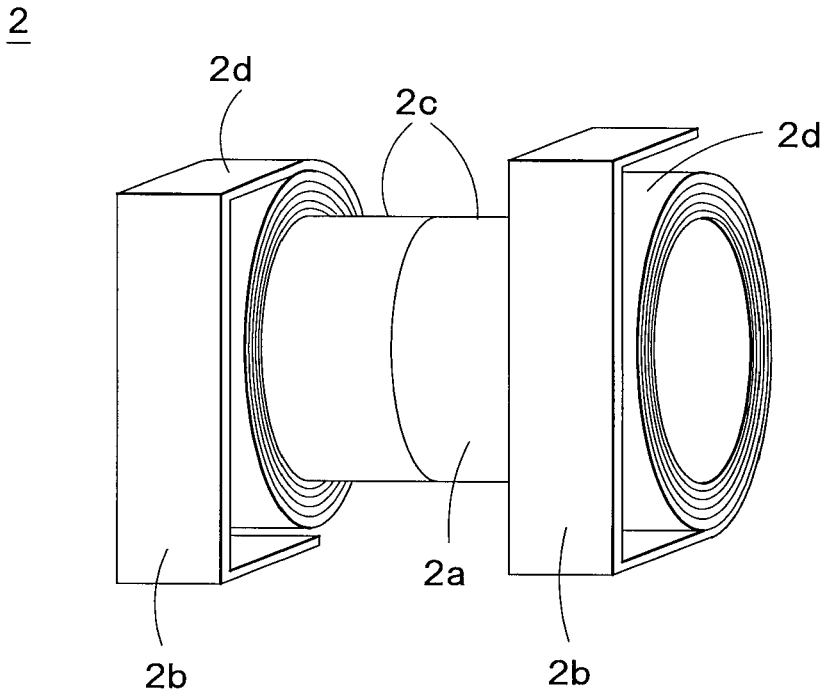
FIG. 1 is a perspective view of a surface-mount inductor of the first embodiment according to the present invention.

As shown in FIG. 1, a coil 2 is a coreless (empty core) coil having symmetrical profile when viewed from a direction orthogonal to the axial line. The coil 2 has two first rolls 2*c*, which are such configured that both ends of a rectangular wire are positioned at the outermost turn and are positioned adjacently along the winding axis, and two second rolls 2*d*, which are configured as two rolls, the inner diameters of which are equal to or larger than the outer diameters of the first rolls 2*c*, and the second winding rolls 2*d* are positioned adjacent to the first rolls 2*c* on opposite sides along the winding axis of the coil 2.

From the outer outermost turn of the second rolls 2*d*, the lead ends 2*b*, which are the ends of the rectangular wire, are brought to the extending direction of the outer peripheries. The respective lead ends 2*b* are brought toward opposite directions from the winding axis and the end portions are formed to be U-shaped to shelter the outermost turn of the coil 2.

The coil 2 thus formed does not suffer from mechanical stress around the inner and outer diameter portions when winding, because the direction of the wide surfaces 2*a* and the direction of the rectangular wire are parallel.

FIG. 2 shows a method of winding the coil 2. For winding the coil 2, a winding machine (not shown) having a pair of spindles (not shown) which has two-roll winding cores 3*a*, 3*b* having different outer diameters is used to wind an insulated rectangular wire.

A pair of spindles 3 includes a pair of first winding cores 3*a*, a pair of winding cores 3*b* adjacent and coaxial to the first winding cores 3*a* and having a diameter larger than that of the first winding cores 3*a*, and a pair of cylindrical base portions 3*c* having a diameter larger than that of the second winding cores 3*b*.

The length in the axial direction of each winding cores is larger than the width of the rectangular wire. The spindle tips 3*aa* are the end faces of the first winding cores 3*a* and are positioned at sides opposite to the second winding cores 3*b*.

Figure 2A:
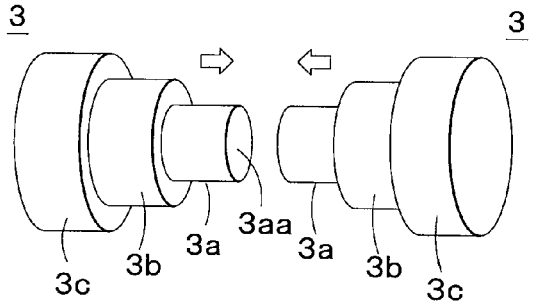
FIGS. 2A, 2B, 2C and 2D show steps in method of winding a coil which is used in the surface-mount inductor of the first embodiment according to the present invention in sequential manner.

Firstly, the two spindles 3 are positioned in a manner that the spindle tips 3*aa* face each other, as shown in FIG. 2A.

Figure 2B:
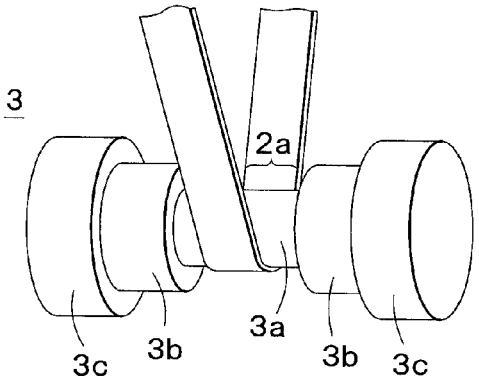

Then, as shown in FIG. 2B, the wide surface 2*a* of the median portion of the rectangular wire is put contact with the first winding cores 3*a*. The ends of the rectangular wire are repetitively wound in opposite directions around the winding cores 3*a* in a manner that the outer diameter of the winding is not larger than the outer diameter of the second winding cores 3*b*, and the two first rolls 2*c* are formed adjacently on the direction of the winding axis.

Figure 2C:
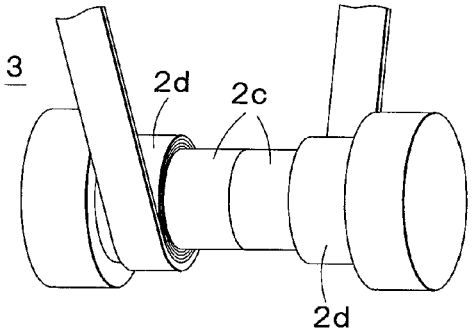

And then, the both ends of the rectangular wire are shifted in opposite directions along the winding axes of the spindles 3 to be in contact with the winding cores 3*b*. And, as shown in FIG. 2C, the rectangular wire is wound on the second winding cores 3*b* to form the two second rolls 2*d*. The rectangular wire is pulled from the outermost turn of the second rolls 2*d* to form the lead ends 2*b* (see FIG. 2D).

Figure 2D:
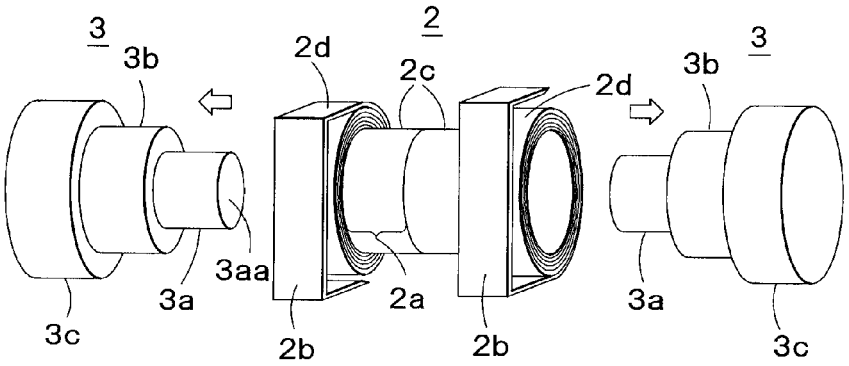

The lead ends 2*b* are pulled from the outermost turn of the coil 2 in its extended directions oppositely each other and the ends are bent to form U-shaped portions. The coil 2 is heated and solidified, and then is removed thereafter from the spindles as shown in FIG. 2D, thus producing the coil 2 which is symmetrical relative to a direction orthogonal to the winding axis.

A molded body 4 which includes the coil 2 will be described in reference to FIG. 3. The molded body 4 is formed by combining two blocks 4*a*. The block 4*a* is formed by applying pressure to a sealant which contains filler with metallic magnetic powder and epoxy resin.

Figure 3:
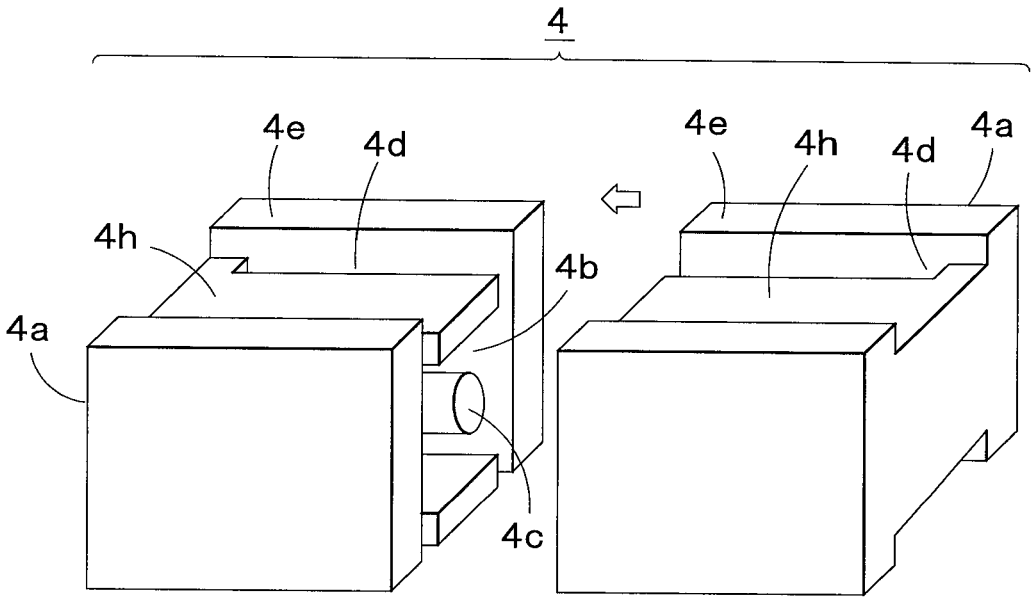
FIG. 3 is a perspective view of the block which is used in the first embodiment according to the present invention.

As shown in FIG. 3, the blocks 4*a* are rectangular parallelepipeds having open end surface and a space 4*b* to accommodate the coil 2 inside. The cylindrical protrusion 4*c* to pass through the winding axis of the coil 2 extends from the central portion of inner wall of the opposite end surface toward the open end surface. The upper and bottom surfaces of the block 4*a* have the same shape, with one of them serving as the mounting face 4*e* (the upper surface in FIG. 3).

Figure 4:
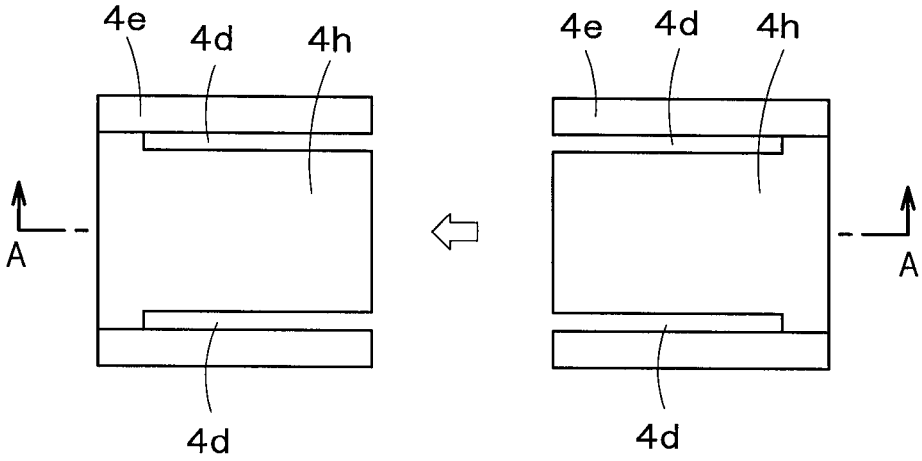
FIG. 4 is a plan view of the mounting face of the block which is used in the surface-mount inductor of the first embodiment according to the present invention.

As shown in FIG. 4, the mounting faces 4*e* are rectangular, with the open surface forming the short side and the other surface forming the long side. At both short sides of the mounting face 4*e*, the elongated slits 4*d* for bringing out the lead ends 2*b* therethrough are provided.

The portion of the mounting face 4*e* bordered by the slits 4*d* forms the supporting portion 4*h* which serves to support the lead ends 2*b* of the coil 2. Namely, the two slits 4*d* and the supporting portion 4*h* constitutes the U-shaped supporting structure to fit to the sectional shape of the lead ends 2*b* (FIGS. 2A-2D).

Figure 5A:
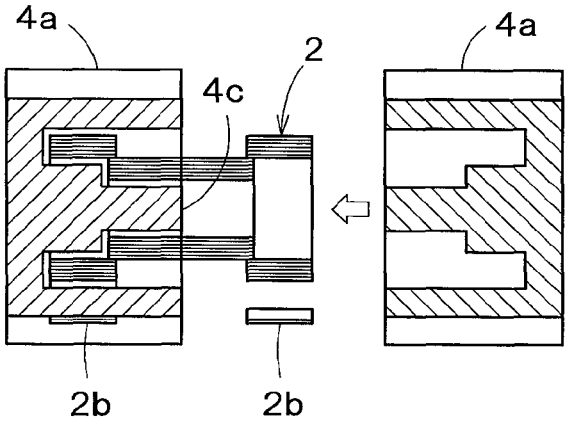
FIGS. 5A, 5B and 5C show steps for manufacturing the surface-mount inductor of the first embodiment according to the present invention, FIG. 5A showing the state before blocks being fitted, FIG. 5B showing the attached blocks, and FIG. 5C showing the state of the mounting face after fitting.
Figure 5B:
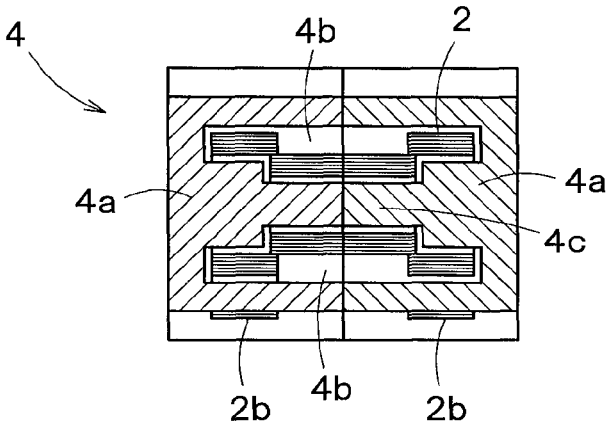
Figure 5C:
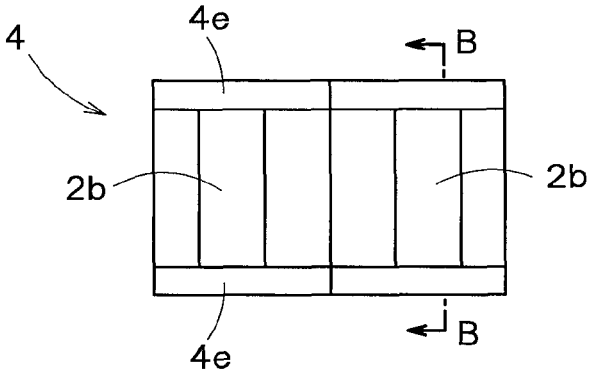

Next, the method for sealing the coil are described, referring to FIGS. 5A-5C.

FIGS. 5A and 5B are sectional views along the line A-A in FIG. 4, namely a sectional view parallel with the mounting face 4*e*, while FIG. 5C is a plan view of the mounting face 4*e*.

As shown in FIG. 5A, the blocks 4*a* are arranged on both sides of the direction of the axis of the coil 2 in a manner that the open sides face each other. In one of the blocks 4*a*, the protrusion 4*c* of the block is inserted into the winding axis of the coil 2 and the lead end 2*b* is pulled out through the slit 4*d* of the mounting face 4*e*.

FIG. 5B shows a state that where other block 4*a* is fitted from the direction of the winding axis of the coil 2. The space 4*b* for accommodating the coil 2 is provided in the inside the block 4*a*. The coil 2 is accommodated inside the two blocks 4*a* with the protrusions 4*c* being inserted into the central portion of the coil 2. The long side of the lead end 2*b* is brought out through one of the two slits 4*d* so as to be parallel with the short side of the mounting face 4*e* and inserted into the other slit 4*d* to be U-shaped in section.

In this state, the two blocks 4*a* which incorporates the coil 2 are pressed in a mold and then heated (thermocompressed). Thus, as shown in FIG. 5C, the lead ends 2*b* of the coil 2 are fixed to the mounting face 4*e* so as to be visible, and the two blocks 4*a* are solidified to form a molded body 4 sealing the coil 2 inside.

Figure 6:
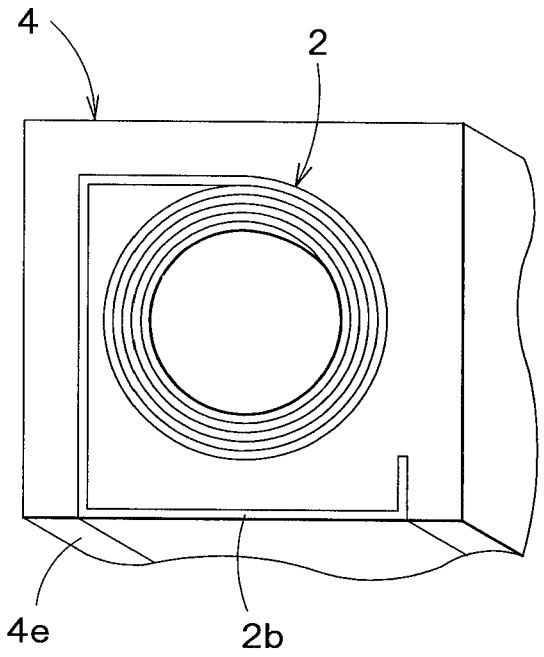
FIG. 6 is a partial sectional view showing the method of manufacturing of the surface-mount inductor of the first embodiment according to the present invention.

FIG. 6 shows the step for forming the external terminals by processing the lead ends 2*b*. FIG. 6 is the sectional view along the B-B line in FIG. 5C.

The lead ends 2*b*, which are embedded in the mounting face 4*e*, and the portion of the lead ends exposed are machined by laser beam to remove the insulation cover therefrom. Because of the flatness of the rectangular wire, the settings for laser processing are uncomplicated. As the laser processing is used to remove the insulation off one face, the process does not require to be repeated.

The lead ends 2*b* are simultaneously sputtered with predetermined ratio of Ni and Cu to form a Ni—Cu layer, subsequently sputtering with Sn to form a Sn layer so as to process the lead ends 2*b* into the external terminals. Because of using the rectangular wire, the adhesiveness to other components may be improved, compared to the case of using a round wire. In addition, the evenness of the mounting face 4*e* can be raised.

Figure 7:
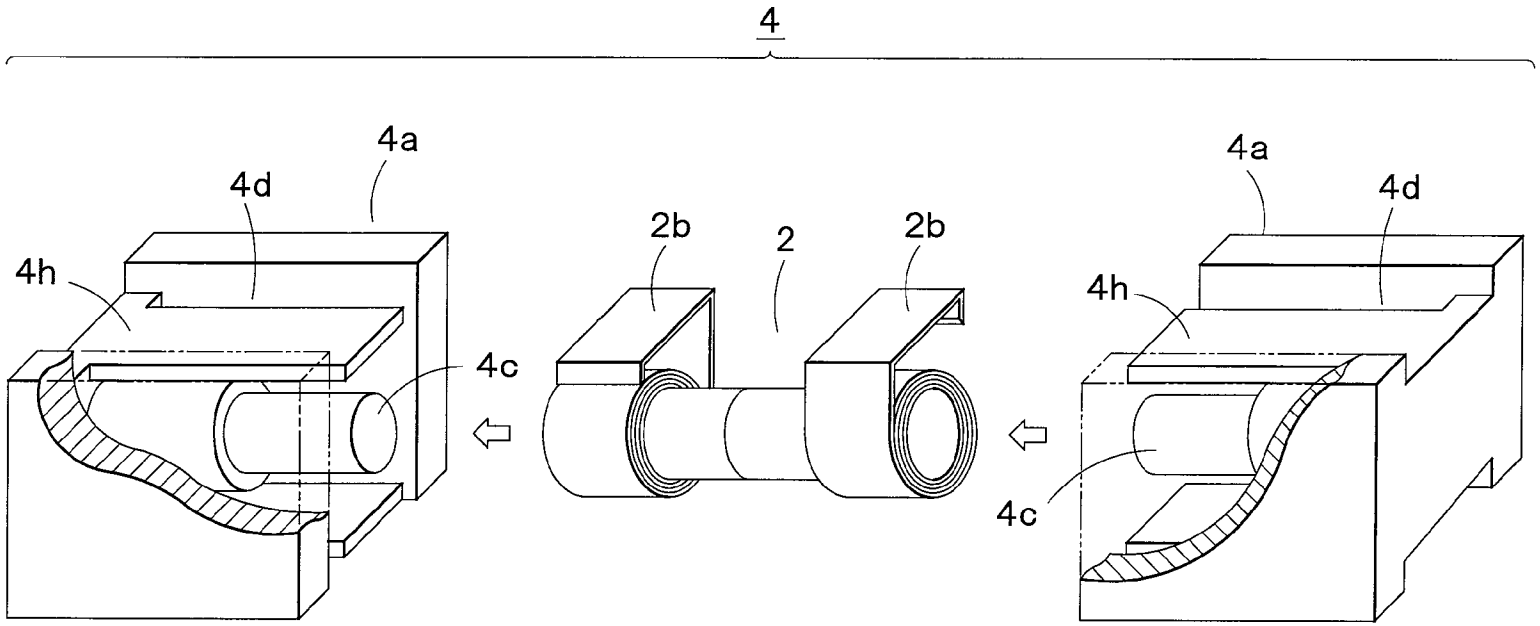
FIG. 7 shows the step for fitting the two blocks and the coil of the first embodiment according to the present invention.

FIG. 7 shows the steps for combining the two blocks 4*a* and the coil 2 according to the first embodiment of the present invention. The left end of the coil 2 is inserted into the block 4*a* (left side in FIG. 7). For this process, the center of the coil 2 is positioned on the protrusion 4*c* of the block 4*a*, and the lead end 2*b* (left side in FIG. 7) of the coil 2 is positioned to be mounted on the supporting portion 4*h* of the block 4*a*. Thus, the coil 2 is pressed toward the left as indicated by the arrow in FIG. 7 so that the coil 2 is fitted with the block 4*a* on the left in FIG. 7.

Then, the block 4*a* on the right side in FIG. 7 is fitted with the left side block 4*a* which is already fitted with the coil 2. For such a process, the central hole of the coil 2 is positioned on the protrusion 4*c* of the block 4*a* at the right side in FIG. 7, and the right-side supporting portion 4*h* is aligned with the right-side lead end 2*b*, and then the block 4*a* on the right side in FIG. 7 is pressed toward the left side as shown by the arrow. As a result, the two U-shaped portions of the lead ends 2*b* support are in turn supported by the supporting portions 4*h*.

Accordingly, the two blocks 4*a* are joined via the coil 2 so the three of them are integrated together. As described before referring to FIG. 5, the molded body 4 is formed by thermocompressing.

Since the surface-mount inductor produced as described above has an entirely symmetrical shape, the electric characteristics are the same regardless of which of the input terminals receives an input. Therefore, there is no need for marking so as to discriminate between terminals and manufacturing cost can be thus reduced.

Embodiment 2

The surface-mount inductor and the method for manufacturing the same according to the second embodiment of the present invention will be described, referring to FIGS. 8-12. The same reference numbers are used in the case the components are equivalent to those of the first embodiment.

The coil and the spindle used in the second embodiment are the same as the first embodiment. The molded body used in the second embodiment is described first.

Figure 8:
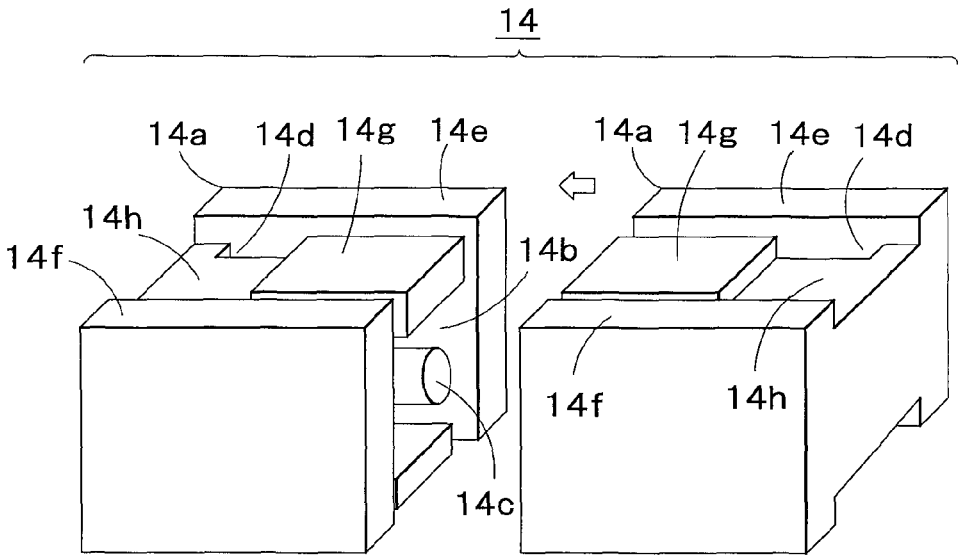
FIG. 8 is a perspective view of the block used in the second embodiment according to the present invention.

As shown in FIG. 8, the molded body 14 is formed by joining the two blocks 14*a*. The blocks 14*a* are made of the sealant containing filler with magnetic powder and epoxy resin.

The block 14*a* is a rectangular parallelepiped which has an aperture at one end surface (right side in FIG. 8) and a space 14*b* for accommodating the coil 2 (not shown). From the center of the inner wall of the end surface opposite to the end surface having the aperture (left side), the cylindrical protrusion 14*c* for inserting in the winding axis of the coil 2 is pointing toward the end surface having the aperture. The upper and bottom surfaces of the block 14*a* are configured to have the same shape, and any one of them being used as the mounting face.

Figure 9:
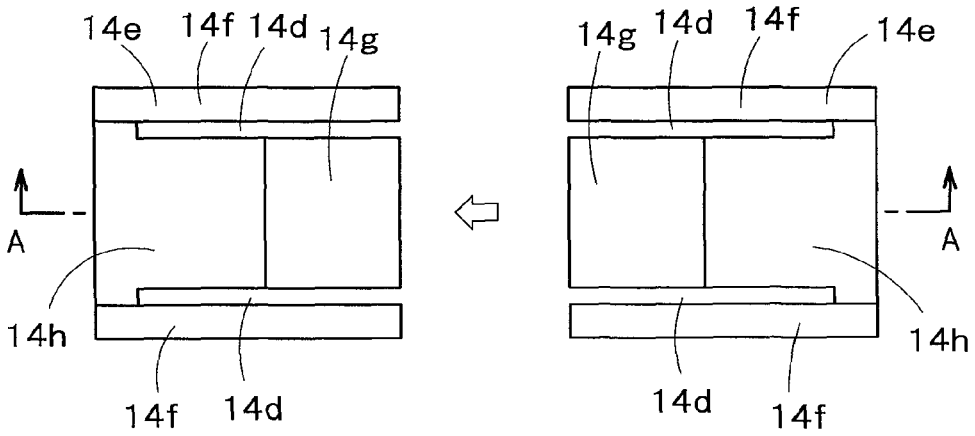
FIG. 9 is a plan view of the block used in the surface-mount inductor of the second embodiment according to the present invention.

As shown in FIG. 9, the shapes of the respective mounting face 14*e* are rectangular, with the vertical side being the short side and the horizontal side being the long side.

At the both ends of the short sides, the mounting face 14*e* has a pair of thin long first protruded portions 14*f*, which protrude from the inside to the outside of the blocks 14*a*, and thin long slits 14*d* for bringing out the lead ends 2*b*. The first protruded portions 14*f* are arranged outside and adjacent to the slits 14*d*. Further, the second protruded portion 14*g* is provided in the area enclosed by the short side of the aperture end, the center in longitudinal direction of the mounting face 14*e* and the two slits 14*d* so as to protrude from the inside to the outside of the blocks 14*a*. The second protruded portions 14*g* serve as a supply source of sealant when sealing the coil 2.

Figure 10A:
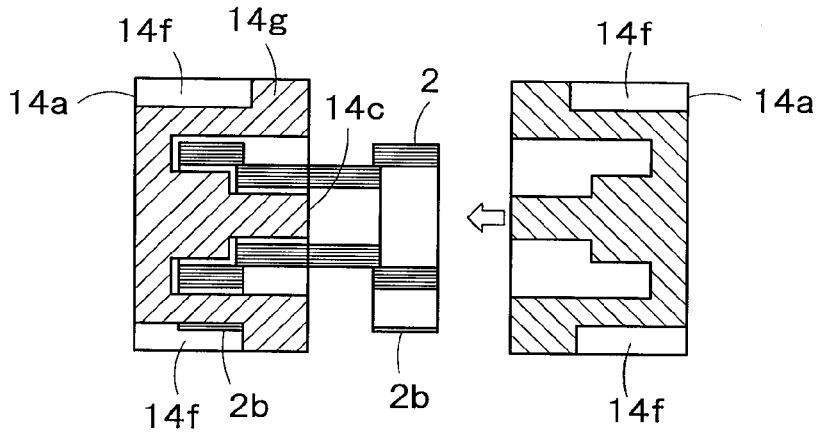
FIGS. 10A, 10B and 10C show sectional views along the line A-A in FIG. 9 for showing the method for manufacturing the first embodiment of the present invention, FIG. 10A showing the state before connecting the blocks, FIG. 10B showing the connected blocks, and FIG. 10C showing the mounting face after connecting the blocks.
Figure 10B:
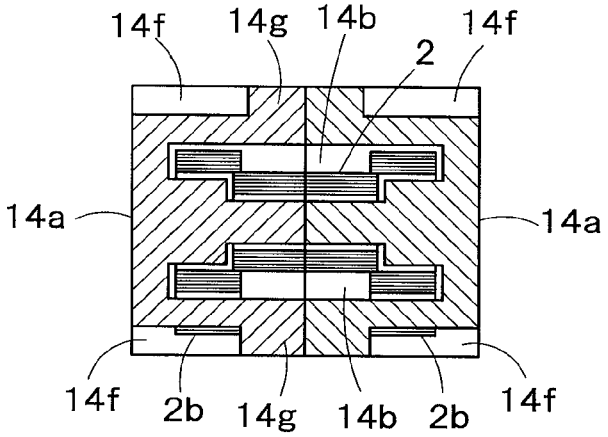

The method for sealing the coil will be described, referring to FIGS. 10A and 10B. FIGS. 10A and 10B are sectional views along the line A-A in FIG. 9, FIG. 10C being a planar view of the mounting face, and FIGS. 11A and 11B being sectional views along the line B-B in FIG. 10C.

As shown in FIG. 10A, the blocks 14*a* are arranged at both sides of the axial direction of the coil 2 so that the ends each having an aperture oppose each other. A space 14*b* for accommodating the coil 2 is provided inside of the blocks 14*a*. As shown in FIG. 10B, the blocks 14*a* are joined at the both axial ends of the coil 2.

Figure 10C:
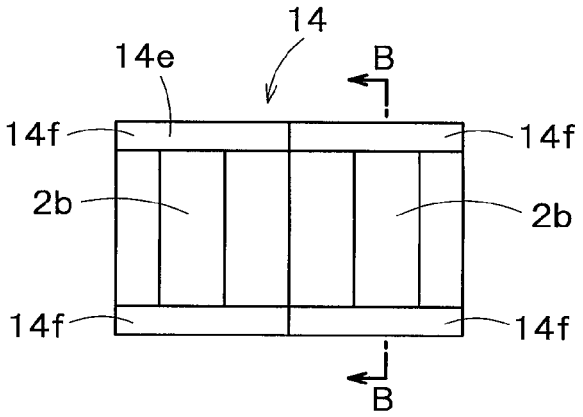

The coil 2 is accommodated in the blocks 14*a*, with the protrusion 14*c* of the blocks 14*a* passing through the hollow core of the coil 2. As shown in FIG. 10C, the lead ends 2*b* are U-shaped in section so as to be brought out from the slits 14*d* at one side of the mounting face 14*e* to be inserted in the slits 14*d* at the other side of the mounting face 14*e*. Thus, the longitudinal direction of the lead ends 2*b* is parallel with the short side of the mounting face 14*e* (not shown).

As shown in FIG. 11, a mold die having the molding body 6 and the upper lid 7 is prepared. The molding body 6 is a rectangular parallelepiped having a space inside for accommodating a molded body 14. The molding body 6 has an inner flat bottomed surface whose area is equal to double of the area of the mounting face 14*e*, namely an area equal to the mounting faces of the molded body 14. The inner depth of the molding body 6 is larger than the radial dimension of the block 14*a*.

The upper lid 7 has a flat bottomed surface, the area of which is equal to double of the area of the mounting face 14*e*, namely is substantially equal to that of the mounting faces of the molded body 14.

Figure 11A:
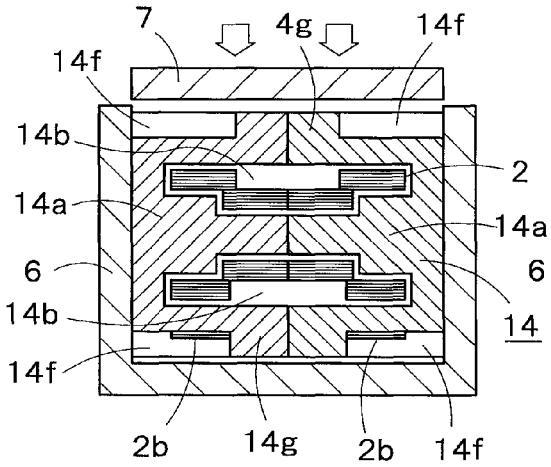
FIGS. 11A and 11B show sectional view, before and after placing the upper lid on the mold, corresponding to the A-A sectional view of FIGS. 10A and 10B for showing the method for manufacturing a surface-mount inductor of the second embodiment according to the present invention.
Figure 11B:
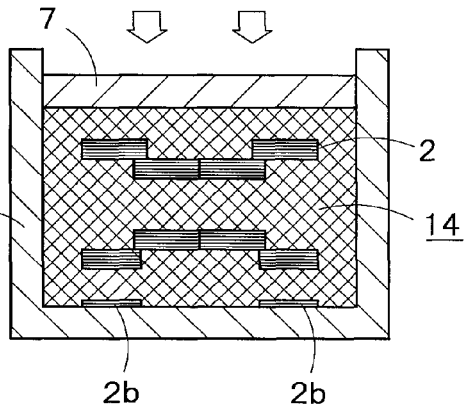

As shown in FIG. 11A, the block 14*a* incorporating the coil 2 is set inside the molding body 6, with the mounting face 14*e* facing downward, and the upper lid 7 being placed thereon from above. Then, as shown in FIG. 11B, applying pressure thereto from above downwards. As a result, a first protruded portion 14*f* and the second protruded portion 14*g* are pressed so that the sealant constituting them fills the spaces 14*b* and the slits 14*d*. Further, they are heated to form the molded body 14. The lead ends 2*b* are attached to the mounting face 14*e* so that they become embedded while being exposed from its surface.

The method for processing the lead ends to be external terminal is described below. The lead ends 2*b* embedded in partially exposed from the surface of the mounting face 14*e*, are irradiated with a laser beam to remove the insulation layer thereof.

Due to the lead ends 2*b* being made of rectangular wire, the settings for laser insulation removal are uncomplicated. Since the laser insulation removal is applied to one surface, it can be finished in one step. The lead ends 2*b* are processed to become external terminals by simultaneously sputtering with predetermined composition of Ni and Cu to form a Ni—Sn layer, then being sputtered with Sn to form a Sn layer thereon. Due to using the rectangular wire, the adherence is superior to that of a round wire. Also, the flatness of the mounting face is significant.

In the surface-mount inductor produced according to the above-mentioned method, electric characteristics are unchanged regardless of the receiving input. Since the marking of the terminals is not needed, manufacturing costs can be reduced.

Figure 12A:
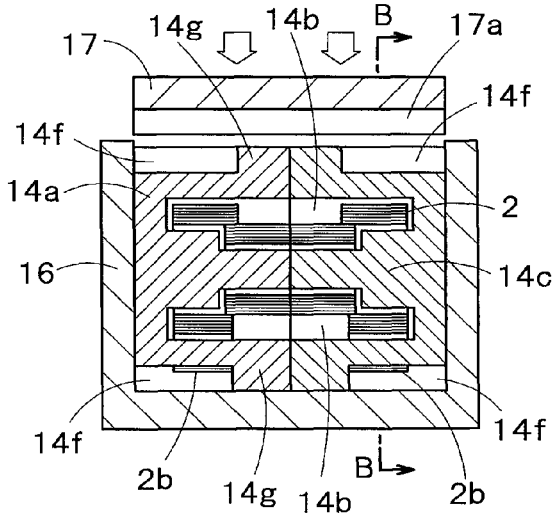
FIGS. 12A and 12B show the method for manufacturing the surface-mount inductor of the second embodiment according to the present invention using a mold with modified corner portions, FIG. 12A being a sectional view corresponding to the A-A sectional view and FIG. 12B being a sectional view corresponding to the B-B sectional view of FIG. 10C.
Figure 12B:
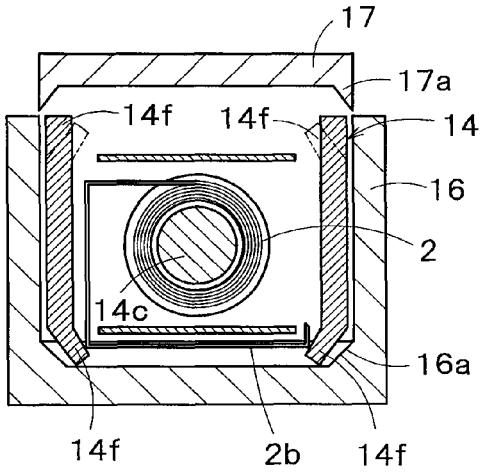

As shown in FIGS. 12A and 12B, the assembly of the molding body 16 and the upper lid 17 can be modified so that the molding body 16 has corners 16*a* (FIG. 12(*b*)) which are inclined upwards and inside, and inclined edges 17*a*. The inclined corners 16*a* are provided at the bottom corners of the molding body 16, and the inclined edges 17*a* are provided at the both sides of the bottom surface of the upper lid 17. Also, the inclined corners 16*a* and the inclined edges 17*a* serve to inwardly press sealant.

The method of forming the assembly of the molding body 16 and the upper lid 17 is declined below. As shown in FIG. 12A, the blocks 14*a* having the coil 2 are placed in the molding body 16, and then the upper lid 17 is placed thereon. Then, vertically applying pressure to the upper lid 17, the sealant constituting the first protruding portion 14*f* is pressed by the corners 16*a* toward the slits 14*d* (FIG. 9) to fill the slits 14*d*, as shown in FIG. 12B which shows views from the orthogonal direction to that of FIG. 12A (B-B section). By heating next, the molded body 14 is formed.

Embodiment 3

Figure 14A:
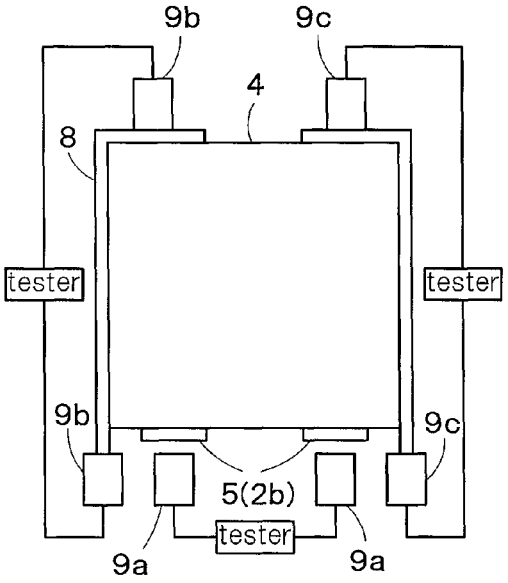
FIGS. 14A, 14B, 14C and 14D show the method for inspecting the surface-mount inductor of the third embodiment according to the present invention, FIG. 14A showing the case when the metal body's both sides are in contact with, but the lead ends are not in contact with, the terminals of a tester.
Figure 14B:
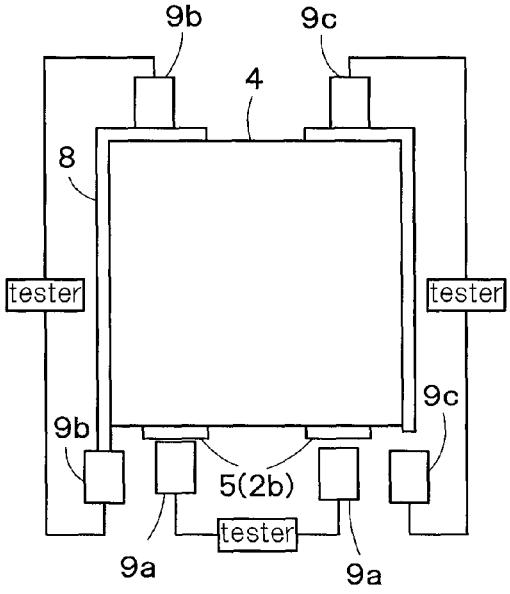
Figure 14C:
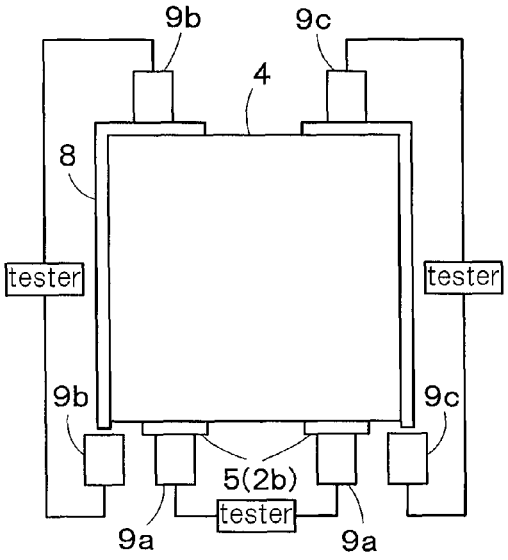
Figure 14D:
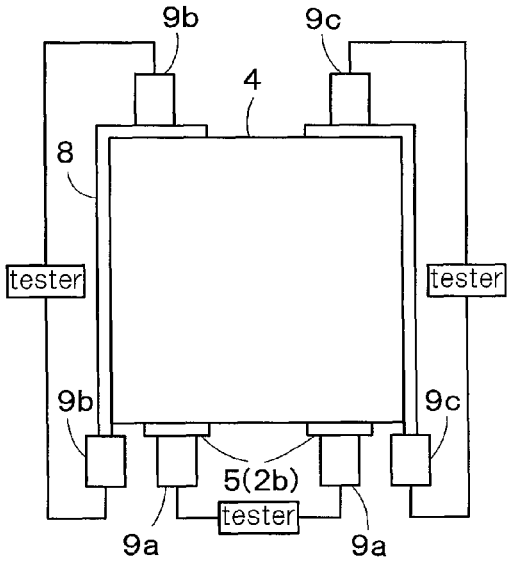
Figure 15:
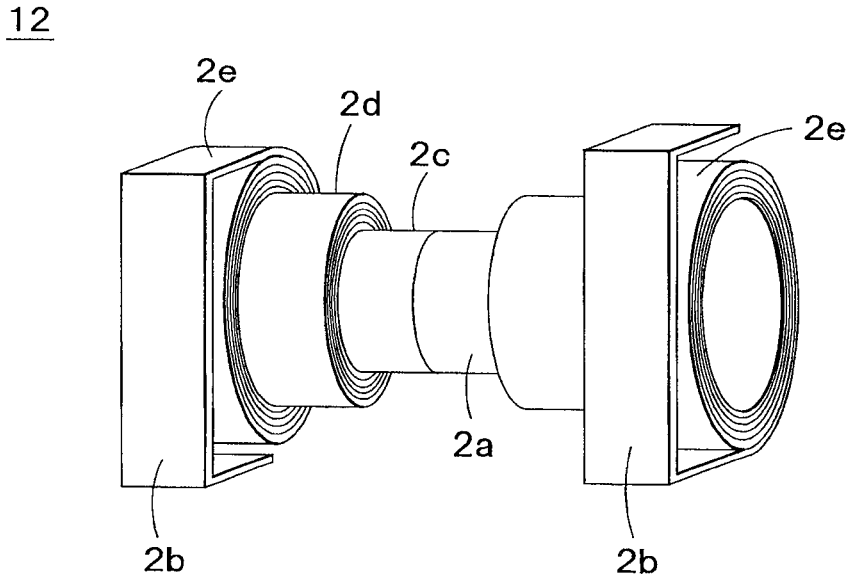
FIG. 15 is a perspective view of other coils that may be used for the surface-mount inductor of the first through third embodiments according to the present invention.

Referring to FIGS. 13-15, the third embodiment according to the present invention and the method for manufacturing the same will be described. The same components in this embodiment as the first and the second embodiments are indicated by the same reference numbers.

A pair of metal bodies 8 are mounted on the molded body 4. The metal bodies 8 and the molded body 4 are in the relationship described below.

Figure 13A:
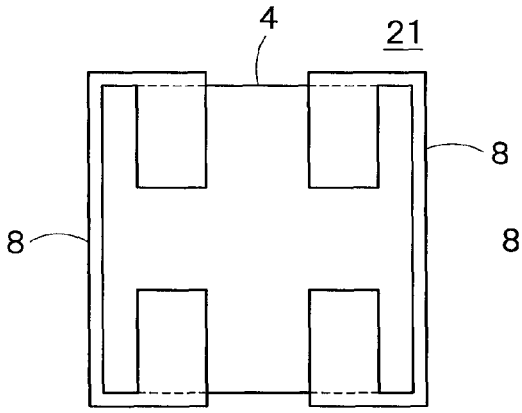
FIGS. 13A, 13B, 13C and 13D show outline views of the surface-mount inductor of the third embodiment according to the present invention, FIG. 13A showing the plan view, FIG. 13B showing the bottom view, and FIG. 13C and FIG. 13D showing the side views.

FIG. 13A is a plan view of the molded body 4, and the metal bodies 8 cover a part of the metal bodies 8.

Figure 13B:
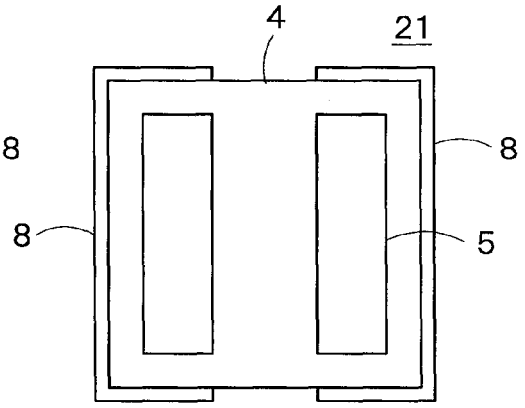

FIG. 13B is a bottom view of the molded body 4. The metal bodies 8 do not cover the bottom surface of the molded body 4 and there is a vacant area between the external terminals 5 and the metal bodies 8.

Figure 13C:
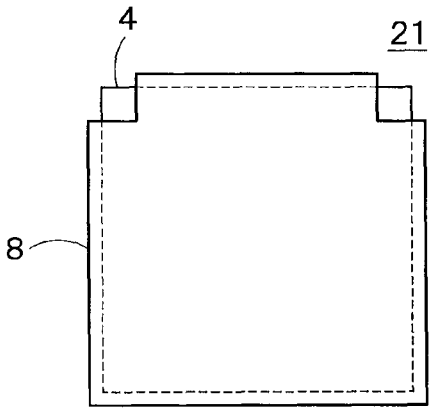

FIG. 13C is a side view, namely a view of FIG. 13A from the left. The metal bodies 8 cover a side surface of the molded body 4, and the lower ends of the metal bodies 8 reach the same level of the surface of the external terminals 5.

Figure 13D:
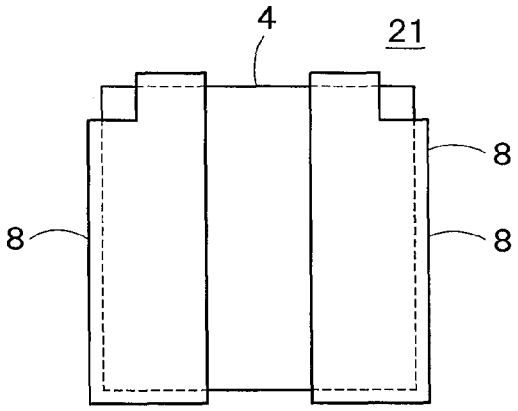

FIG. 13D is a side view, namely is a view of FIG. 13A from below. A pair of metal bodies 8 covers the both ends of the side view, and there are vacant areas at the center of the side surface.

As described above, the metal bodies 8 are mounted on the molded body 4 to form a surface-mount inductor 21.

Next, referring to FIG. 14, the method for inspecting a surface-mount inductor will be described. Using an inspection device, which includes first through third pairs of probes, inspection as to whether the metal bodies 8 are accurately mounted is carried out. If a surface-mount inductor, in which the metal bodies 8 are accurately mounted on the molded body 4, is considered acceptable, the probes for inspection are fixed at the predetermined positions relative to the acceptable article.

More specifically, the first probes are fixed at the positions where the probes contact the external terminals 5, namely the lead ends 2*b*, which is exposed at the mounting face 4*e* of the acceptable article. Similarly, the second probes are fixed at the positions to contact the lower end and the upper surface of one of the metal bodies 8. And, the third probes are fixed at the positions to contact the lower end and the upper surface of the other metal body 8. Since the relative distances between the probes are fixed, the first probes 9*a*, the second probes 9*b* and the third probes 9*c* conduct one another when inspecting an acceptable article.

On the contrary, if a defective article, on which the metal bodies 8 are not mounted accurately, is inspected, anyone of the probes does not conduct.

The detailed examples are as follows. In the case that the lower ends of the metal bodies 8 reach the positions lower than the surface of the lead ends 2*b* (FIGS. 5 and 10) of the coil 2, which expose at the mounting face of the molded body 4, the first probe 9*a* does not contact and the inspection device judges as a defective article. Such a surface-mount inductor is not mounted to a substrate of a device accurately.

In another case, one of the lower ends of the metal bodies 8 reaches the position lower than the surface of the lead ends 2*b* as shown in FIG. 14B, the first probes 9*a* and the third probes 9*c* do not contact and the inspection device judges as defective. Such a surface-mount inductor has the metal bodies 8 which have insufficient area for covering the surface-mount inductor.

In the other case, the probes do not reach the surface of lead ends 2*b*, the second probe 9*b* and the third probe 9*c* do not contact as shown in FIG. 14C and the inspection device judges as defective. Such a surface-mount inductor is not mounted on the substrate accurately.

In contrast, in the case that the first probe 9*a*, the second probe 9*b* and the third probe 9*c* contact, the inspection device judges that the metal bodies 8 are accurately mounted, and the article is acceptable.

Since the surface-mount inductor according to the present invention includes the coil 2 which has symmetrical shape so that electric characteristics are also symmetrical to be adjustable to input a signal anyone of the input terminals. Thus, there is no need to indicate marks on terminals of polarization and it is possible to reduce manufacturing costs. In addition, the provision of the metal bodies 8 prevents the leakage of magnetic flux as well as invasion of electromagnetic noise from outside, thus stable electric characteristics are available.

Although the present invention is described as to the inductor and method for manufacturing the same via the embodiments, the scope of the present invention should not be limited to the embodiments. For example, the long and short sides of the embodiments can be altered, and the coil can be constituted by one layer, or three-layered coils having some inner diameters as shown in FIG. 15. The coils may have more than three layers.

The coils having more than two layers, denoting the first, second, . . . , from innermost to outside according to the layer construction. The inner diameter of the roll of number X+1 is larger than the outer diameter of the roll of number X.

As shown in FIG. 15, for example, the coil 12, having three layers of different diameters, has such a configuration that the inner diameter of the secondary inner side roll is larger than the outer diameter of the innermost roll, and the inner diameter of the thirdly inner side roll is larger than the outer diameter of the secondary inner side roll. The outer and inner diameters of the innermost roll are smallest and outer rolls have larger diameters, respectively.

The second rolls may be inclined along the winding axis of the coil.

The spindle for winding the coil needs to have cores of numbers equal to the number of coil windings, and one base portion. In the case that the spindle has plural cores, the cores are designated as the first core, the second core, . . . . The cores abovementioned have column-like shape and are adjacently arranged, and the outer diameter of the core of number X+1 is larger than the outer diameter of the core of number X. The core having largest diameter is not used for winding and is used as a stopper. The number of the second cores may be more than one.

The shape of the spindle may be in any shape provided that it has symmetrical shape and does not harm winding operation. For example, the respective cores may be obliquely declined, and the cores have sloped between them, not steps as shown in embodiments.

EXPLANATION OF CODES

1, 11, 21 surface-mount inductor
2, 12 coil
2*a* wide surface
2*b* lead end
2*c* first roll
2*d* second roll
3 spindle
3*a* first core
3*b* second core
3*c* base portion
4, 14 molded body
4*a*, 14*a* block
4*b*, 14*b* space
4*c*, 14*c* protrusion
4*d*, 14*d* slit
4*e*, 14*e* mounting face
4*h*, 14*h* supporting portion
14*f* first protruded portion
14*g* second protruded portion
5 external terminal
6, 16 molding body
16*a* edge of mold
7, 17 upper lid
17*a* edge of upper lid
8 metal body
9*a* first probe
9*b* second probe
9*c* third probe

What is claimed is:

1. A surface-mount inductor being provided with a molded body which includes a coil formed by winding a rectangular wire which is sealed using sealant containing resin and filler, at least a surface of the molded body being a mounting face, wherein the coil comprises:

two first rolls wound in a two-roll arrangement along the winding axis, the ends of the wire being brought out to their outermost turn; and two second rolls wound in positions adjacent to and each on opposite sides of the first rolls along the winding axis, the diameter of the innermost turn being equal to or larger than the diameter of the outermost turn of the first rolls, the outermost turns of the first rolls being at least partially not in contact with the innermost turns of the second rolls, the ends of the wire are brought out from the outermost turn of the second rolls as lead ends which are coated in a manner that the winding axis is parallel with the mounting face and that the lead ends are at least partially exposed on the side of the mounting face.

2. A surface-mount inductor claimed in claim 1, wherein the lead ends are brought out in the opposite directions from the outermost turn of the coil, and are bent to be U-shaped.

3. A surface-mount inductor claimed in claim 1, comprising third rolls wound at different positions along the winding axis, and the diameter of the innermost turn being equal to or larger than that of the second rolls, wherein the lead ends are brought out from the outermost turn of the third rolls.

4. A surface-mount inductor claimed in claim 1, comprising a pair of metal bodies provided on the upper and bottom surfaces of the molded body with vacant areas, for covering the upper, bottom and side surfaces of the molded body and the lower ends of the metal bodies reaching the surface of the lead ends.

* * * * *